US011244640B2

(12) United States Patent
Yin

(10) Patent No.: US 11,244,640 B2
(45) Date of Patent: Feb. 8, 2022

(54) METHOD AND APPARATUS FOR ADJUSTING LUMINANCE OF DISPLAY DEVICE

(71) Applicant: BOE Technology Group Co., Ltd., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 668 days.

(21) Appl. No.: 16/072,872

(22) PCT Filed: Dec. 15, 2017

(86) PCT No.: PCT/CN2017/116574

§ 371 (c)(1),
(2) Date: Jul. 25, 2018

(87) PCT Pub. No.: WO2018/205616

PCT Pub. Date: Nov. 15, 2018

(65) Prior Publication Data

US 2021/0035512 A1 Feb. 4, 2021

(30) Foreign Application Priority Data

May 12, 2017 (CN) ..... 201710333374.9

(51) Int. Cl.
*G09G 3/36* (2006.01)

(52) U.S. Cl.
CPC ... *G09G 3/3607* (2013.01); *G09G 2320/0233* (2013.01); *G09G 2320/0271* (2013.01)

(58) Field of Classification Search
CPC ..... G09G 3/3607; G09G 2320/0233; G09G 2320/0271
See application file for complete search history.

(56) References Cited

U.S. PATENT DOCUMENTS 7,317,462 B2 * 1/2008 Lu ..... G09G 3/3611 345/690
7,576,750 B2 8/2009 Eckhardt et al.
(Continued)

FOREIGN PATENT DOCUMENTS

CN 101286231 A 10/2008
CN 102165513 A 8/2011
(Continued)

OTHER PUBLICATIONS

Search Report and Written Opinion issued in corresponding International Patent Application No. PCT/CN2017/116574, dated Mar. 14, 2018.

*Primary Examiner* — Chanh D Nguyen
*Assistant Examiner* — Ngan T. Pham-Lu
(74) *Attorney, Agent, or Firm* — McDermott Will & Emery LLP

(57) ABSTRACT

The present disclosure provides a method and an apparatus for adjusting luminance of a display device. The method of adjusting luminance of the display device includes: determining a gray scale level interval on a target gray scale curve based on a maximum luminance value and a minimum luminance value to be set; determining a target luminance value for each grayscale level of the display device on the target gray scale curve according to the gray scale level interval; and adjusting luminance of the grayscale level of the display device based on the determined target luminance value.

12 Claims, 4 Drawing Sheets

(56) References Cited

U.S. PATENT DOCUMENTS

| | | | | |
|---|---|---|---|---|
| 8,681,189 | B2 | 3/2014 | Wallener et al. | |
| 9,055,263 | B2 * | 6/2015 | Umeda | H04N 1/60 |
| 2006/0038807 | A1 | 2/2006 | Eckhardt et al. | |
| 2011/0169881 | A1 | 7/2011 | Wallener et al. | |

FOREIGN PATENT DOCUMENTS

| | | | |
|---|---|---|---|
| CN | 103680438 | A | 3/2014 |
| CN | 105528999 | A | 4/2016 |
| CN | 106354467 | A | 1/2017 |

* cited by examiner

METHOD AND APPARATUS FOR ADJUSTING LUMINANCE OF DISPLAY DEVICE

CROSS-REFERENCE TO RELATED APPLICATION(S)

This application is a US national phase application of a PCT international application (PCT/CN2017/116574) which is entitled "METHOD AND APPARATUS FOR ADJUSTING LUMINANCE OF DISPLAY DEVICE" and filed on Dec. 15, 2017, which claims priority to Chinese Application No. 201710333374.9, entitled "METHOD AND APPARATUS FOR ADJUSTING GRAYSCALE LEVEL LUMINANCE OF DISPLAY DEVICE" and filed on May 12, 2017, both of which are incorporated herein by reference in their entireties.

TECHNICAL FIELD

The present disclosure relates to the field of display technology, and in particular, to a method and an apparatus for adjusting grayscale level luminance of a display device.

BACKGROUND

With continuous development of the display technology, display devices capable of satisfying various performance requirements in various aspects, such as luminance, contrast, resolution, and size etc., can be manufactured. The display device with high performance plays an important role in various fields. However, in some fields, there are still other strict requirements in other aspects, in addition to the above general performance parameters. For example, in the field of medical display devices, the medical display devices need to have better integrity and consistency, in order to, for example, more accurately hold a consultation by images. Specifically, integrity requires that doctors at different consultation locations can see the same image display effect (luminance, gray scale, contrast, etc.) through different displays, so that judgment and communication may be performed based on the same facts. Consistency requires that the medical display device used by the same doctor can present the same display effect for the same display object under different use periods, use locations, and use environments.

In the medical field, in order to achieve the above-mentioned integrity and consistency, a Grayscale Standard Display Function (GSDF) is specified in a Digital Imaging and Communication (DICOM) standard in the medical field, which usually requires adjustment on a grayscale level luminance of the medical display device, so as to be consistent with a curve of the GSDF.

There is a need for a method that may adjust the grayscale level luminance of the display device to be adapted to a specific standard, such as the DICOM standard, quickly and accurately.

SUMMARY

In order to at least partially solve or alleviate the above problems, the present disclosure provides a method and an apparatus for luminance adjustment of a display device.

According to an aspect of the present disclosure, a method of adjusting luminance of a display device is provided. The method includes: determining a gray scale level interval on a target gray scale curve based on a maximum luminance value and a minimum luminance value to be set; determining a target luminance value for each grayscale level of the display device on the target gray scale curve according to the gray scale level interval; and adjusting luminance of the grayscale level of the display device based on the determined target luminance value.

In an embodiment, the maximum luminance value and the minimum luminance value to be set are a maximum luminance value and a minimum luminance value of the grayscale levels of the display device, respectively.

In an embodiment, the maximum luminance value and the minimum luminance value to be set are a maximum luminance value and a minimum luminance value, respectively, which are set according to a predefined standard.

In an embodiment, the standard is a Grayscale Standard Display Function "GSDF" specified in a Digital Imaging and Communications "DICOM" standard in the medical field.

In an embodiment, the method further includes: enabling the display device to display a grayscale level image for each grayscale level; obtaining an initial luminance value of each grayscale level; and determining the maximum luminance value and the minimum luminance value according to the initial luminance values.

In an embodiment, said determining the target luminance value for each grayscale level includes: equally dividing the gray scale level interval by the number of the grayscale levels of the display device; and determining a luminance value corresponding to each equal-division point on the target gray scale curve as the target luminance value for corresponding grayscale level of the display device.

In an embodiment, said adjusting the luminance of the grayscale levels of the display device includes: increasing the initial luminance value of the grayscale level to be adjusted, if the target luminance value of the grayscale level to be adjusted is higher than the initial luminance value thereof; and decreasing the initial luminance value of the grayscale level to be adjusted, if the target luminance value of the grayscale level to be adjusted is lower than the initial luminance value thereof.

In an embodiment, the initial luminance value of a grayscale level is increased or decreased by increasing or decreasing an initial color component value of the grayscale level.

In an embodiment, the initial color component value is read from the display device.

In an embodiment, the initial luminance value which is closest to the target luminance value of the grayscale level to be adjusted is selected from the initial luminance values of the respective grayscale levels of the display device; and the initial color component value of the grayscale level corresponding to the selected initial luminance value is used as the initial color component value of the grayscale level to be adjusted.

In an embodiment, the method further includes: determining, for each of the adjusted grayscale levels, whether the adjusted initial luminance value satisfies a predetermined condition; and repeating the adjusting step if the adjusted initial luminance value does not satisfy the predetermined condition, until all the adjusted initial luminance values satisfy the predetermined condition.

In an embodiment, the predetermined condition is:

$$\frac{|R_{adjust}(j) - R_{target}(j)|}{R_{target}(j)} \leq p,$$

-continued where $$R_{adjust}(j) = \frac{2 \times (L_{adjust}(j) - L_{adjust}(j-1))}{(L_{adjust}(j) + L_{adjust}(j-1)) \times (T(j) - T(j-1))},$$

$$R_{target}(j) = \frac{2 \times (L_{target}(j) - L_{target}(j-1))}{(L_{target}(j) + L_{target}(j-1)) \times (T(j) - T(j-1))},$$

$L_{adjust}(j)$ is the adjusted initial luminance value of the j-th grayscale level, $L_{target}(j)$ is the target luminance value of the j-th grayscale level, T(j) is the gray scale level value of the j-th grayscale level, and p is a constant between 0 and 1, where j=1, 2, . . . , N−1, and N is the number of the gray scale levels of the display device.

According to another aspect of the present disclosure, an apparatus for adjusting luminance of a display device is provided. The apparatus includes a memory and a processor. The memory stores a maximum luminance value and a minimum luminance value of the display device and target gray scale curve data. The processor is configured to determine a gray scale level interval on a target gray scale curve based on a maximum luminance value and a minimum luminance value to be set; determine a target luminance value for each grayscale level of the display device on the target gray scale curve according to the gray scale level interval; and adjust luminance of the grayscale level of the display device based on the determined target luminance value.

In an embodiment, the maximum luminance value and the minimum luminance value to be set are a maximum luminance value and a minimum luminance value of the grayscale levels of the display device, respectively.

In an embodiment, the maximum luminance value and the minimum luminance value to be set are a maximum luminance value and a minimum luminance value, respectively, which are set according to a predefined standard.

In an embodiment, the standard is a Grayscale Standard Display Function "GSDF" specified in a Digital Imaging and Communications "DICOM" standard in the medical field.

In an embodiment, the processor is further configured to: enable the display device to display a grayscale level image for each grayscale level; obtaining an initial luminance value of each grayscale level; and determining the maximum luminance value and the minimum luminance value according to the initial luminance values.

In an embodiment, the processor is further configured to: equally divide the gray scale level interval by the number of the grayscale levels of the display device; and determine a luminance value corresponding to each equal-division point on the target gray scale curve as the target luminance value for corresponding grayscale level of the display device.

In an embodiment, the processor is further configured to: increase the initial luminance value of the grayscale level to be adjusted, if the target luminance value of the grayscale level to be adjusted is higher than the initial luminance value thereof; and decrease the initial luminance value of the grayscale level to be adjusted, if the target luminance value of the grayscale level to be adjusted is lower than the initial luminance value thereof.

In an embodiment, the processor is further configured to: increase or decrease the initial luminance value of a grayscale level by increasing or decreasing an initial color component value of the grayscale level.

In an embodiment, the initial color component value is read from the display device.

In an embodiment, the processor is further configured to: select the initial luminance value which is closest to the target luminance value of the grayscale level to be adjusted from the initial luminance values of the respective grayscale levels of the display device; and the use initial color component value of the grayscale level corresponding to the selected initial luminance value as the initial color component value of the grayscale level to be adjusted.

In an embodiment, the processor is further configured to: determine, for each of the adjusted grayscale levels, whether the adjusted initial luminance value satisfies a predetermined condition; and repeating the adjusting if the adjusted initial luminance value does not satisfy the predetermined condition, until all the adjusted initial luminance values satisfy the predetermined condition.

In an embodiment, the predetermined condition is:

$$\frac{|R_{adjust}(j) - R_{target}(j)|}{R_{target}(j)} \le p,$$

where $$R_{adjust}(j) = \frac{2 \times (L_{adjust}(j) - L_{adjust}(j-1))}{(L_{adjust}(j) + L_{adjust}(j-1)) \times (T(j) - T(j-1))},$$

$$R_{target}(j) = \frac{2 \times (L_{target}(j) - L_{target}(j-1))}{(L_{target}(j) + L_{target}(j-1)) \times (T(j) - T(j-1))},$$

$L_{adjust}(j)$ is the adjusted initial luminance value of the j-th grayscale level, $L_{target}(j)$ is the target luminance value of the j-th grayscale level, T(j) is the gray scale level value of the j-th grayscale level, and p is a constant between 0 and 1, where j=1, 2, . . . , N−1, and N is the number of the gray scale levels of the display device.

BRIEF DESCRIPTION OF THE DRAWINGS

In order to explain the technical solutions in the embodiments of the present disclosure or prior art more clearly, drawings needed to be used in description of the embodiments will be briefly described below. Obviously, the drawings in the following description are merely some embodiments of the present disclosure. The skilled in the art may also obtain other drawings based on these drawings without creative labor.

DETAILED DESCRIPTION

Particular embodiments of the present disclosure will be described in detail below. It should be noted that the embodiments described herein are only for illustration but do not limit the present disclosure. In the following description, numerous specific details are set forth in order to provide a thorough understanding of the present disclosure. However, it will be apparent to the skilled in the art that the present disclosure need not be practiced with these specific details. In other instances, well-known circuits, materials, or methods are not described in detail in order to avoid obscuring the present disclosure.

Throughout this specification, references to "one embodiment", "an embodiment", "one example" or "an example" means that particular features, structures, or characteristics described in connection with the embodiment or example are included in at least one embodiment of the present disclosure. Thus, phrases of "in one embodiment", "in an embodiment", "one example" or "an example" appearing throughout the specification are not necessarily all referring to the same embodiment or example. In addition, the particular features, structures, or characteristics may be combined in any suitable combination and/or sub-combination in one or more embodiments or examples. Moreover, the skilled in the art should understand that the drawings provided herein are for illustration purposes only and the drawings are not necessarily drawn to scale. As used herein, the term "and/or" includes any and all combinations of one or more of listed related items.

In the description, some contents are described with the DICOM standard as the example background. However, it should be understood that the technical solutions of the present disclosure are not limited to the DICOM standard, and are not limited to the medical field. The technical solutions of the embodiments of the present disclosure are also applicable when the display device is adjusted based on other specific standards in other fields. For example, the technical solutions of the embodiments of the present disclosure may also be used in specialized display devices, such as military, geological exploration, etc.

Hereinafter, the embodiments of the present disclosure will be described in detail with reference to the accompany drawings.

Figure 1:
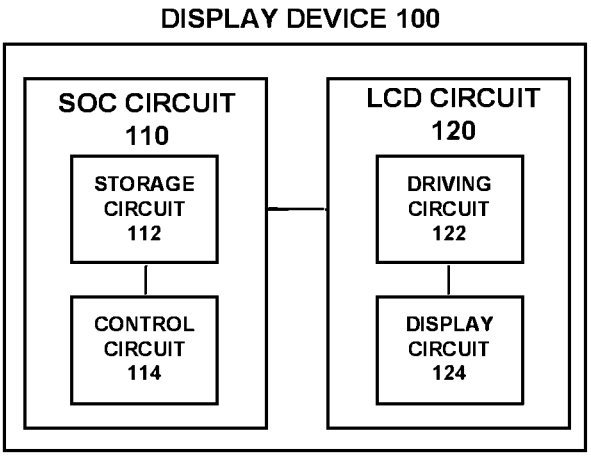
FIG. 1 shows a simplified block diagram of an exemplary display device.

First, FIG. 1 shows a simplified block diagram of an exemplary display device 100.

As seen from FIG. 1, the display device 100 includes a System-On-Chip (SOC) control circuit 110 and a Liquid Crystal Display (LCD) circuit 120. The SOC control circuit 110 includes a storage circuit 112 and a control circuit 114. The LCD circuit 120 includes a driving circuit 122 and a display circuit 124. In order to clearly describe the embodiments of the present disclosure without causing confusion to the skilled in the art, the structure of the display device 100 is simplified. It should be understood by the skilled in the art that the structure of the display device 100 is not limited thereto, and it may also include circuits for realizing other functions. In other embodiments, the display device 100 may only include the LCD circuit 120, and the SOC control circuit 110 may be located in a separate device, such as a graphics card device or a processor device etc. In addition, it should be understood by the skilled in the art that that for circuits already shown in the display device 100, connection relationships thereof are not limited thereto, and the embodiments of the present disclosure do not limit thereto.

Specifically, the storage circuit 112 stores initial values of grayscale levels of the display device 100. These initial values may be lookup table (LUT) values. The LUT values may be read, stored or modified by control of the control circuit 114, so that the LCD circuit 120 presents respective luminance according to driving signals generated based on the corresponding LUT values. In an embodiment, the LUT value may be a three-component value. For example, in an RGB representation, they are an R component, a G component, and a B component; in a tristimulus value representation, they are an X component, a Y component, and a Z component; and in a color coordinate representation, they are an x coordinate component, a y coordinate component, and a Y component. In another embodiment, the LUT value may be a single component value.

As an example, an exemplary format of the LUT value in an RGB representation is shown in Table 1 below:

TABLE 1

| Grayscale Level | R-LUT Value | G-LUT Value | B-LUT Value |
|---|---|---|---|
| $GL_0$ | | | |
| $GL_1$ | | | |
| $GL_2$ | | | |
| . . . | . . . | . . . | . . . |
| $GL_{253}$ | | | |
| $GL_{254}$ | | | |
| $GL_{255}$ | | | |

As shown above, each row in Table 1 corresponds to a Grayscale Level (GL). Table 1 shows GL0 to GL255, respectively. In each row, three LUT component values corresponding to R, G and B, respectively, i.e., an R-LUT value, a G-LUT value, and a B-LUT value, are included.

The control circuit 114 is connected to the storage circuit 112, and may control the storage circuit 112 to send a signal to the LCD circuit 120 based on the stored LUT values. The control circuit 114 may be a dedicated control circuit or a general-purpose control circuit. In an embodiment, the control circuit 114 is connected to a specific interface, such as an I2C interface, and the control circuit 114 operates the storage circuit 112 according to a command or a request received from the specific interface. In another embodiment, the control circuit 114 is connected to a plurality of different interfaces, such as the I2C interface and/or a DVI interface etc. The control circuit 114 processes signals from different interfaces according to different protocols. In yet another embodiment, the control circuit 114 may be implemented as a plurality of control circuits. Each control circuit is connected to an interface and processes the signal from the corresponding interface.

According to the received signal, the control circuit 114 may perform different operations on the storage circuit 112 or control the storage circuit 112 to perform different operations. For example, the control circuit 114 may receive a read signal, read the stored initial value from the storage circuit 112 according to the read signal, and send the read initial value to the sender of the read signal or a third party. For another example, the control circuit 114 may receive a modification signal, and modify the initial value stored in the storage circuit 112 according to the modification signal.

The driving circuit 122 is configured to generate a corresponding driving signal according to the received signal, and drive the display circuit 124 to perform corresponding display. The drive circuit 122 is connected to the storage circuit 112 to receive the LUT values from the storage circuit 112 and generate corresponding driving signals based on the LUT values. It should be understood that although only the driving circuit 122 connected to the storage circuit 112 is shown in FIG. 1, the driving circuit 122 may also be connected to other components to obtain other types of output data and generate the driving signal based on some or all of the received data.

The display circuit 124 is configured to display under the driving of the driving signal. For example, the display circuit 124 may be implemented as a display panel.

Figure 2:
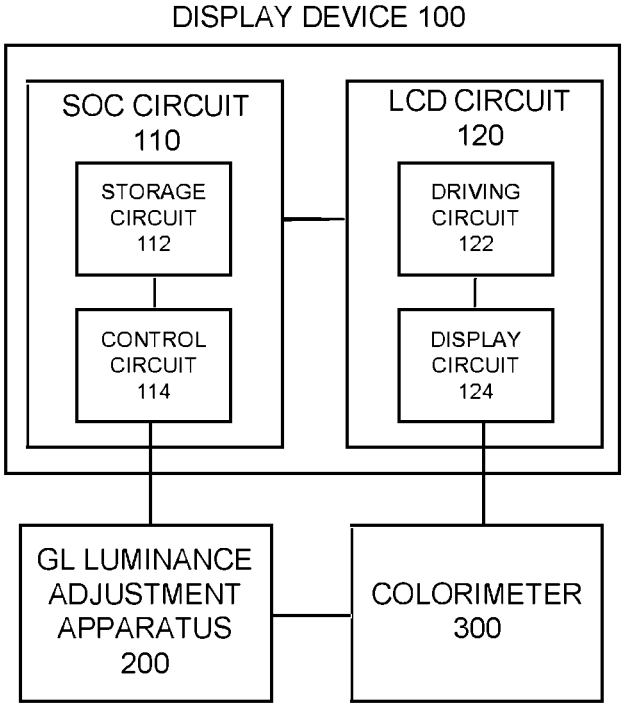
FIG. 2 schematically shows an exemplary arrangement of connecting an apparatus for luminance adjustment of a display device according to an embodiment of the present disclosure to the display device and a colorimeter to adjust luminance of the display device.

FIG. 2 schematically shows an exemplary arrangement of connecting an apparatus 200 for luminance adjustment of a display device (called "adjustment apparatus 200" hereinafter) according to an embodiment of the present disclosure to the display device 100 and a colorimeter 300 to adjust luminance of the display device 100.

As seen from FIG. 2, the colorimeter 300 is connected to the LCD circuit 120 of the display device 100 to measure the luminance of an image displayed by the display circuit 124 in the display device 100. The adjustment apparatus 200 is connected to the colorimeter 300 and the SOC circuit 110 of the display device 100, receives the measured luminance value from the colorimeter 300, and adjusts the initial value stored in the storage circuit 112 of the SOC circuit 110 based on the luminance value.

The adjustment apparatus 200 is further configured to control the SOC circuit 110 to send an image corresponding to a specific grayscale level to the LCD circuit 120 for display through the display circuit 124 of the LCD circuit 120. Therefore, the colorimeter 300 may measure the luminance of the grayscale level image displayed according to the initial value stored in the storage circuit 122, and send to the adjustment apparatus 200 to determine how to adjust.

In an embodiment, the adjustment apparatus 200 is also configured to read the stored initial value from the storage circuit 122. In another embodiment, the adjustment apparatus 200 does not necessarily read data from the storage circuit 122.

It should be understood that although the adjustment apparatus 200 and the colorimeter 300 shown in FIG. 2 are two separate components, in other embodiments, the adjustment apparatus 200 may include a colorimeter circuit so that no separate colorimeter 300 is needed any more.

Figure 3:
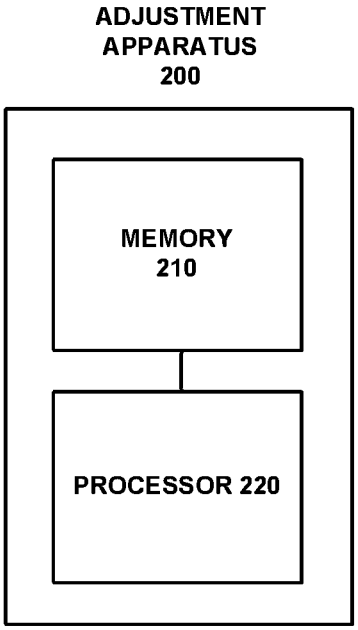
FIG. 3 shows an exemplary block diagram of an apparatus for luminance adjustment according to an embodiment of the present disclosure.

FIG. 3 shows an exemplary block diagram of an adjustment apparatus 200 according to an embodiment of the present disclosure.

As seen from FIG. 3, the adjustment apparatus 200 includes a memory 210 and a processor 220.

The memory 210 is used to store or buffer various data, such as the initial luminance values of the respective grayscale levels of the display device (e.g., the display device 100), the adjusted initial luminance values, the initial color component values, and the like, obtained by the adjustment apparatus 200 from other entities, e.g., the display device 100, the colorimeter 300, etc. The memory 210 is also used to store various intermediate values generated during the adjustment, such as gray scale level values of end points and equal-division points of the determined gray scale interval on the target gray scale curve, and the target luminance values of the respective gray scale values, etc. The memory 210 is also used to store data in advance, such as curve data of the target gray scale curve.

The processor 220 performs an operation for adjusting the luminance of the display device, e.g., the display device 100. In an embodiment, the processor 220 may be configured to perform at least a part of steps in methods 400, 600 for luminance adjustment of the display device as described below in connection with FIG. 4 and FIG. 6.

Figure 4:
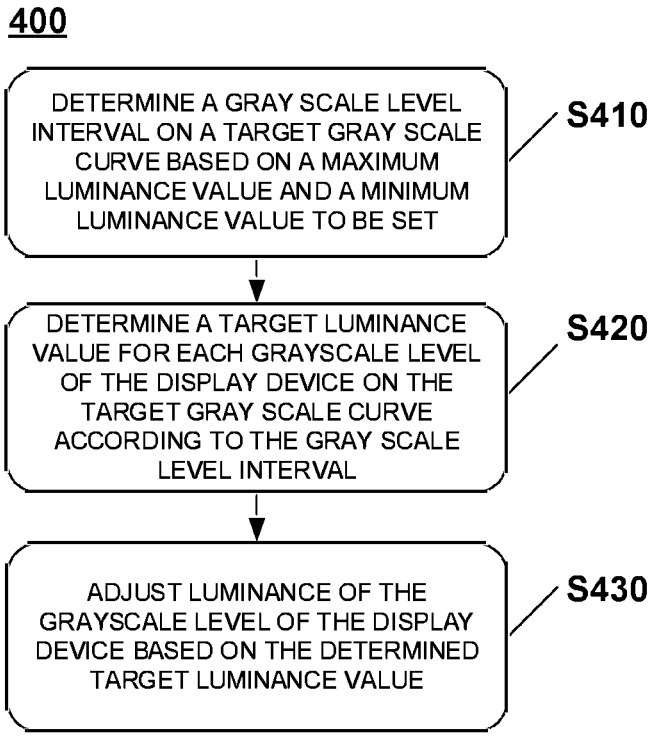
FIG. 4 shows a flowchart of a method for luminance adjustment of a display device according to an embodiment of the present disclosure.

FIG. 4 shows a flowchart of a method for luminance adjustment of a display device (e.g., the display device 100) according to an embodiment of the present disclosure. As an embodiment of the present disclosure, as seen from FIG. 4, the method 400 starts from step S410, in which a gray scale level interval on a target gray scale curve is determined based on a maximum luminance value and a minimum luminance value to be set. Then in step S420, a target luminance value for each grayscale level of the display device on the target gray scale curve is determined according to the gray scale level interval. Finally in step S430, luminance of the grayscale level of the display device is adjusted based on the determined target luminance value.

Firstly in step S410, the gray scale level interval on the target gray scale curve is determined according to the maximum luminance value and the minimum luminance value to be set. In an embodiment, the maximum luminance value and the minimum luminance value to be set may be a maximum luminance value and a minimum luminance value of the grayscale levels of the display device, respectively. As a result, the same device may be guaranteed to display the same image in different situations. In an embodiment, the maximum luminance value and the minimum luminance value to be set may be a maximum luminance value and a minimum luminance value, respectively, which are set according to a predefined standard. In an embodiment, the standard may be a Grayscale Standard Display Function "GSDF" specified in a Digital Imaging and Communications "DICOM" standard in the medical field. As a result, integrity of different devices when displaying the same image may be guaranteed.

The number of the grayscale levels of the display device is determined by the number of bits of the input signal that the display device is adapted to receive. For example, if the display device is an 8-bit display, it has $2^8=256$ grayscale levels.

In an embodiment, in order to obtain the maximum luminance value and the minimum luminance value, it is required to first enable the display device to display grayscale level images of its respective grayscale levels, so that the luminance of the grayscale images may be measured to obtain the initial luminance values of the respective grayscale levels. Thus, a maximum value and a minimum value, i.e., the maximum luminance value and the minimum luminance value, may be determined from the initial luminance values of the respective grayscale levels. For example, in the arrangement as shown in FIG. 2, the adjustment apparatus 200 may instruct the SOC circuit 110 to send the grayscale image to the LCD circuit 120 through an interface (e.g., the DVI interface) to be displayed by the display circuit 124. Therefore, the colorimeter 300 may measure the luminance of the displayed image to obtain the initial luminance value of each grayscale level. The adjustment apparatus 200 obtains respective initial luminance values from the colorimeter 300, and determines the maximum luminance value and the minimum luminance value therefrom.

In another embodiment, according to a monotonicity of the grayscale level curve (Gamma curve), it can be displayed for only the first grayscale level and the last grayscale level of the display device, and the initial luminance value measured for the first grayscale level is used as the minimum luminance value, and the initial luminance value measured for the last grayscale level is used as the maximum luminance value.

In another embodiment, the maximum luminance value and the minimum luminance value may be specified manually by the user or selected from alternative values according to the model of the display device. In another embodiment, the maximum luminance value and the minimum luminance value may be set according to a predefined standard. In an embodiment, the standard may be a Grayscale Standard Display Function "GSDF" specified in a Digital Imaging and Communications "DICOM" standard in the medical field.

The target gray scale curve may be any curve with the gray scale levels as horizontal coordinates and gray scales (luminance) as vertical coordinates. The number of the gray scale levels is not limited by the number of the grayscale levels of the display device. In an embodiment, the number of the gray scale levels is greater than the number of the grayscale levels of the display device. A gray scale space is divided by different gray scale levels, and each gray scale level has specific luminance to form a gray scale curve.

Figure 5:
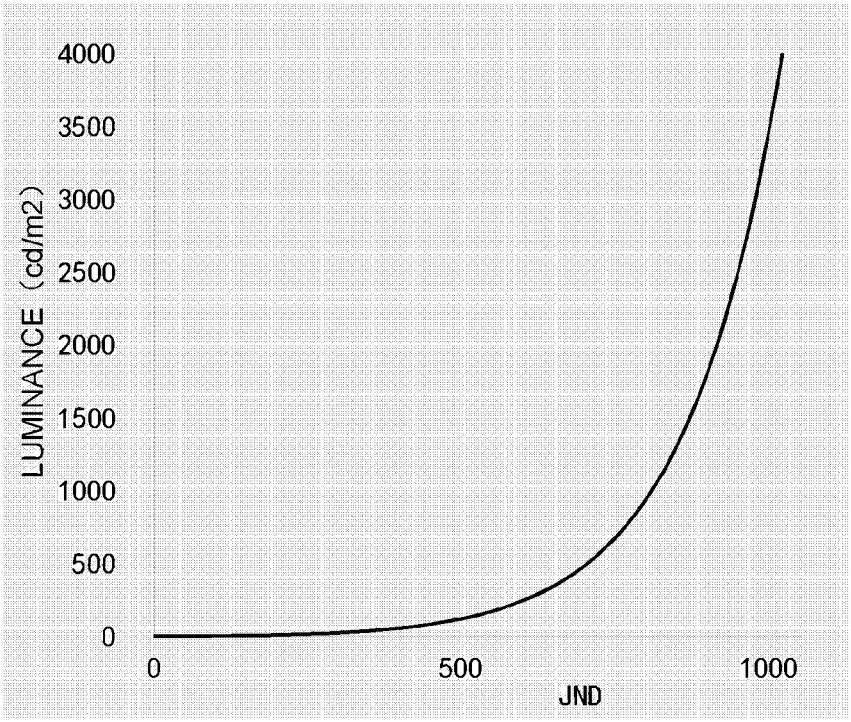
FIG. 5 shows a curve of a gray scale standard display function.

For example, in the DICOM standard, the GSDF curve is an exemplary target gray scale curve. In the following, the GSDF curve will be described as an example. Specifically, Chapter 14 of the DICOM standard document defines the GSDF function, and its function curve is shown in FIG. 5. As seen from FIG. 5, the GSDF curve takes Just Noticeable Difference (JND) values as horizontal coordinates and luminance as vertical coordinates. From this curve, it can be seen that the JND value indicates a grayscale level value that divides the gray scale range of the display device into 1024 levels (greater than the number of grayscale levels of a typical display device, e.g. 256 grayscale levels of an 8-bit display device), each level corresponding to a luminance value.

In step S410, the determination of the gray scale level interval on the target gray scale curve may be achieved by operations as follows. First, the target gray scale level value corresponding to the minimum luminance value on the target gray scale curve is determined as a first end point of the gray scale level interval, i.e., a lower limit. Then, the target gray scale level value corresponding to the minimum luminance value on the target gray scale curve is determined as a second end point of the gray scale level interval, i.e., an upper limit. Thus, the gray scale level interval may be defined by the first end point and the second end point.

Taking the GSDF curve as the target gray scale curve as an example, it is assumed that the number of the grayscale levels of the display device is N, the minimum luminance value is L(0), and the maximum luminance value is L(N−1). With the GSDF function curve shown in FIG. 5, the gray scale level JND(0) corresponding to L(0) and the gray level JND(N−1) corresponding to L(N−1) are determined. JND(0) and JND(N−1) are endpoints of the gray scale level interval, indicating that the JND range in which the display device displays DICOM characteristics is JND(0)~JND(N−1), and the luminance range is L(0)~L(N−1).

Specifically, the following calculation formula (e.g., N=256) may be used when JND is calculated according to the luminance as described above:

$$JND(0)=A+B\times\log_{10}L(0)+C\times(\log_{10}L(0))^2+D\times(\log_{10}L(0))^3+E\times(\log_{10}L(0))^4+F\times(\log_{10}L(0))^5+G\times(\log_{10}L(0))^6+H\times(\log_{10}L(0))^7+I\times(\log_{10}L(0))^8$$

$$JND(255)=A+B\times\log_{10}L(255)+C\times(\log_{10}L(255))^2+D\times(\log_{10}L(255))^3+E\times(\log_{10}L(255))^4+F\times(\log_{10}L(255))^5+G\times(\log_{10}L(255))^6+H\times(\log_{10}L(255))^7+I\times(\log_{10}L(255))^8$$

where values of A, B, C, D, E, F, G, H, and I satisfy:

| | | |
|---|---|---|
| A = 71.498068 | D = 9.8247004 | G = −0.18014349 |
| B = 94.593053 | E = 0.28175407 | H = 0.14710899 |
| C = 41.912053 | F = −1.1878455 | I = −0.017046845 |

Next in step S420, according to the gray scale level interval on the target gray scale curve determined in step S410, the target luminance value for each grayscale level of the display device may be obtained.

In an embodiment, the determining the target luminance value for each grayscale level may be achieved by operations as follows. First, the determined gray scale level interval is equally divided (e.g., by N−1) according to the number of the grayscale levels of the display device. Then, the luminance value corresponding to each equal-division point on the target gray scale curve is determined as the target luminance value for corresponding grayscale level of the display device.

Specifically, taking the GSDF function curve as an example, the equal-division may be calculated by the following formula:

$$JND(j)=JND(0)+\frac{JND(N-1)-JND(0)}{N-1}\times j$$

where j=1, 2, . . . , N−1.

Next, according to the respective JND(j) obtained by the equal-division, the luminance values corresponding to the respective points may be obtained by the following formula (again e.g., N=256):

$$\log_{10}L_{target}(j)=\frac{a+c\times\ln JND(j)+e\times(\ln JND(j))^2+g\times(\ln JND(j))^3+m\times(\ln JND(j))^4}{1+b\times\ln JND(j)+d\times(\ln JND(j))^2+f\times(\ln JND(j))^3+h\times(\ln JND(j))^4+k\times(\ln JND(j))^5}$$

where $L_{target}(j)$ is the target luminance value of the j-th gray scale, and values of constants a, b, c, d, e, f, g, h, k, m satisfy:

| | | | |
|---|---|---|---|
| a = −1.301877 | d = −1.0320229E−1 | g = −2.5468404E−2 | k = 1.2992634E−4 |
| b = −2.5840191E−2 | e = 1.3646699E−1 | h = −3.1978977E−3 | m = 1.3635334E−3 |
| c = 8.0242636E−2 | f = 2.8745620E−2 | | |

It should be noted that the above division (equal-division) approach is not unique, and other divisions may be used.

Finally, in step S430, the luminance of the grayscale level of the display device is adjusted based on the target luminance value determined in step S420.

In this step, the adjustment particularly includes: increasing the initial luminance value of the grayscale level to be adjusted, if the target luminance value of the grayscale level to be adjusted is higher than the initial luminance value thereof; and decreasing the initial luminance value of the grayscale level to be adjusted, if the target luminance value of the grayscale level to be adjusted is lower than the initial luminance value thereof.

In an embodiment, the initial luminance value may be adjusted by changing a parameter corresponding to the initial luminance value.

In an embodiment, the initial luminance value of a grayscale level is increased or decreased by increasing or decreasing an initial color component value of the grayscale level.

The initial color component value may be stored in the storage circuit (e.g., the storage circuit 112 in FIG. 1) of the display device. The initial color component value may be a LUT value. As described above, in an embodiment, the LUT value may be a three-component value. For example, in an RGB representation, they are an R component, a G component, and a B component; in a tristimulus value representation, they are an X component, a Y component, and a Z component; and in a color coordinate representation, they are an x coordinate component, a y coordinate component, and a Y component. In another embodiment, the LUT value may be a single component value, i.e., there is only a single initial color component value for each grayscale level (e.g., a black and white display device).

In an embodiment, each adjustment only causes each initial color component value to change by a particular step value. The step value may be predetermined or specified by the user through input or the like. For example, in the case of RGB components, the R component, G component, and B component of the grayscale level to be adjusted may all be increased by 1 under the condition that the target luminance value of the grayscale level to be adjusted is higher than its initial luminance value.

In another embodiment, the above-described initial color component values of the respective gray levels of the display device may also be read from the display device to facilitate more optimal adjustment.

Specifically, in this embodiment, for a specific grayscale level to be adjusted, luminance adjustment is implemented by operations as follows. First, the target luminance value which is closest to the target luminance value of the grayscale level to be adjusted is selected from the initial luminance values of the respective grayscale levels of the display device. Then, the initial color component value (read already) of the grayscale level corresponding to the selected initial luminance value is used as the initial color component value of the grayscale level to be adjusted.

Figure 6:
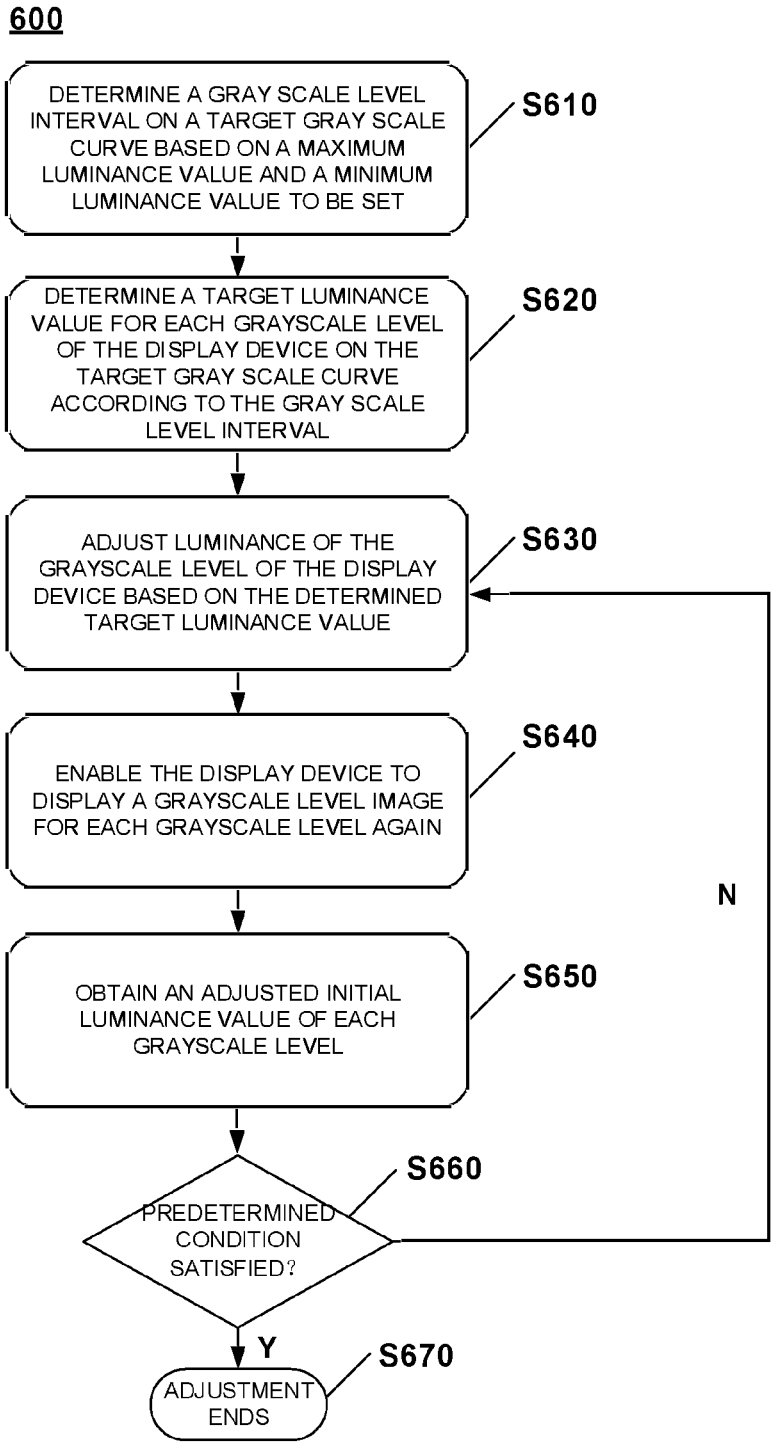
FIG. 6 shows a flowchart of a method for luminance adjustment of a display device according to another embodiment of the present disclosure.

FIG. 6 shows a flowchart of a method 600 for luminance adjustment of a display device (e.g., the display device 100) according to another embodiment of the present disclosure. Steps S610-S630 of the method 600 correspond to the steps S410-S430 of the method 400. Detailed description thereof may refer to that of FIG. 4 as described above, and will be omitted here for simplicity.

In the method 600, it is determined for each of the adjusted grayscale levels whether the adjusted initial luminance value satisfies a predetermined condition; and repeating the adjusting step if the adjusted initial luminance value does not satisfy the predetermined condition, until all the adjusted initial luminance values satisfy the predetermined condition.

Specifically, the method 600 may further include steps S640-S670.

First, after step S630 of adjusting the luminance of the grayscale level of the display device, in step S640, the display device is enabled to display the grayscale level images for the respective grayscale levels again, so that the luminance of the grayscale images may be measured to obtain the adjusted initial luminance values of the respective grayscale levels.

Then, in step S650, the adjusted initial luminance values of the respective grayscale levels are obtained.

For example, in the arrangement as shown in FIG. 2, the adjustment apparatus 200 may instruct the SOC circuit 110 to send the grayscale image to the LCD circuit 120 again through an interface (e.g., the DVI interface) to be displayed by the display circuit 124. Therefore, the colorimeter 300 may measure the luminance of the displayed image to obtain the adjusted initial luminance value of each grayscale level. The adjustment apparatus 200 obtains the adjusted initial luminance values from the colorimeter 300.

Next in step S660, for each grayscale level to be adjusted, it is determined whether the adjusted initial luminance value satisfies a predetermined condition.

In an embodiment, the predetermined condition is defined by a luminance response value R:

$$\frac{|R_{adjust}(j) - R_{target}(j)|}{R_{target}(j)} \leq p,$$

where $$R_{adjust}(j) = \frac{2 \times (L_{adjust}(j) - L_{adjust}(j-1))}{(L_{adjust}(j) + L_{adjust}(j-1)) \times (T(j) - T(j-1))},$$

$$R_{target}(j) = \frac{2 \times (L_{target}(j) - L_{target}(j-1))}{(L_{target}(j) + L_{target}(j-1)) \times (T(j) - T(j-1))},$$

$L_{adjust}(j)$ is the adjusted initial luminance value of the j-th grayscale level, $L_{target}(j)$ is the target luminance value of the j-th grayscale level, T(j) is the gray scale level value of the j-th grayscale level, p is a constant between 0 and 1.

In a case of the GSDF function curve, T(j) is JND(j).

In another embodiment, the predetermined condition is defined by a luminance difference:

For each grayscale level, $|L_{adjust}(j)-L_{target}(j)| \leq p'$, where p' is a positive constant. For example, in an embodiment, p' may have an order of tens.

In another embodiment, the predetermined condition is defined by an overall luminance difference over the entire gray scale level interval:

For the entire interval, $\Sigma_0^{N-1}|L_{adjust}(j)-L_{target}(j)| \leq p''$, where p" is a positive constant. For example, in an embodiment, p" may have an order of hundreds.

If it is determined in step S660 that the adjusted initial luminance value satisfies the predetermined condition, the method 600 proceeds to step S670 to end the adjustment.

If it is determined in step S660 that the adjusted initial luminance value does not satisfy the predetermined condition, the method 600 proceeds to step S630 to use the adjusted initial luminance value as the initial luminance value for the next round of adjustment. Such an iteration continues, until the resulting adjusted initial luminance value satisfies the predetermined condition.

The above detailed description has set forth numerous embodiments using schematics, flowcharts, and/or examples. Where such schematics, flowcharts, and/or examples contain one or more functions and/or operations, the skilled in the art should understand that each of the functions and/or operations in such diagrams, flowcharts, or examples may be implemented individually and/or collectively by various structures, hardware, software, firmware, or substantially any combination thereof. In an embodiment, several portions of the subject matter described in the embodiments of the present disclosure may be implemented via application specific integrated circuits (ASICs), field programmable gate arrays (FPGAs), digital signal processors (DSPs), or other integrated formats. However, the skilled in the art will recognize that some aspects of the embodiments disclosed herein may be implemented in integrated circuits as a whole or partially equivalently, implemented as one or more computer programs running on one or more computers (e.g., one or more programs running on one or more computer systems), implemented as one or more programs running on one or more processors (e.g., one or more programs running on a plurality of microprocessors), implemented as firmware, or substantially in any combination of the above manners, and the skilled in the art will have abilities of designing circuits and/or writing in software and/or firmware codes according to the present disclosure. In addition, the skilled in the art will recognize that the mechanisms of the subject matter described in the present disclosure may be distributed as a plurality of forms of program products; and regardless of the specific types of signal bearing media for performing the distribution, the exemplary embodiments of the subject matter of the present disclosure are all applicable. Examples of the signal bearing media include, but not limited to, recordable type media, such as floppy disks, hard disk drives, compact disks (CDs), digital versatile disks (DVDs), digital tapes, computer memory, and the like; and transmission type media, such as digital and and/or analog communication media (e.g., fiber optic cables, waveguides, wired communications links, wireless communications links, etc.).

Although the present disclosure has been described with reference to several exemplary embodiments, it will be understood that the terms used are an illustrative and not restrictive. Since the present disclosure can be embodied in various forms without departing from the spirit or substance of the present disclosure, it should be understood that the above-described embodiments are not limited to any of the foregoing details but should be construed broadly within the spirit and scope defined by the appended claims. Therefore, all changes and modifications that fall within the scope of the claims or the equivalent thereof shall be covered by the appended claims.

I claim:

1. A method of adjusting luminance of a display device, the method comprising:

enabling the display device to display a grayscale level image for each grayscale level;

obtaining an initial luminance value of each grayscale level; and determining the maximum luminance value and the minimum luminance value according to the initial luminance values;

determining a gray scale level interval on a target gray scale curve based on a maximum luminance value and a minimum luminance value to be set;

determining a target luminance value for each grayscale level of the display device on the target gray scale curve according to the gray scale level interval; and adjusting luminance of the grayscale level of the display device based on the determined target luminance value, wherein said adjusting the luminance of the grayscale levels of the display device comprises:

increasing the initial luminance value of the grayscale level to be adjusted, if the target luminance value of the grayscale level to be adjusted is higher than the initial luminance value thereof; and decreasing the initial luminance value of the grayscale level to be adjusted, if the target luminance value of the grayscale level to be adjusted is lower than the initial luminance value thereof;

determining, for each of the adjusted grayscale levels, whether the adjusted initial luminance value satisfies a predetermined condition; and repeating the adjusting step if the adjusted initial luminance value does not satisfy the predetermined condition, until all the adjusted initial luminance values satisfy the predetermined condition, wherein the predetermined condition is:

$$\frac{|R_{adjust}(j) - R_{target}(j)|}{R_{target}(j)} \leq p,$$

where $$R_{adjust}(j) = \frac{2 \times (L_{adjust}(j) - L_{adjust}(j-1))}{(L_{adjust}(j) + L_{adjust}(j-1)) \times (T(j) - T(j-1))},$$

$$R_{target}(j) = \frac{2 \times (L_{target}(j) - L_{target}(j-1))}{(L_{target}(j) + L_{target}(j-1)) \times (T(j) - T(j-1))},$$

$L_{adjust}(j)$ is the adjusted initial luminance value of the j-th grayscale level, $L_{target}(j)$ is the target luminance value of the j-th grayscale level, T(j) is the gray scale level value of the j-th grayscale level, and p is a constant between 0 and 1, where j=1, 2, . . . , N−1, and N is the number of the gray scale levels of the display device.

2. The method according to claim 1, wherein the maximum luminance value and the minimum luminance value to be set are a maximum luminance value and a minimum luminance value of the grayscale levels of the display device, respectively.

3. The method according to claim 1, wherein the maximum luminance value and the minimum luminance value to be set are a maximum luminance value and a minimum luminance value, respectively, which are set according to a predefined standard.

4. The method according to claim 1, wherein said determining the target luminance value for each grayscale level comprises:

equally dividing the gray scale level interval by the number of the grayscale levels of the display device; and determining a luminance value corresponding to each equal-division point on the target gray scale curve as the target luminance value for corresponding grayscale level of the display device.

5. The method according to claim 1, wherein the initial color component value is read from the display device; the initial luminance value which is closest to the target luminance value of the grayscale level to be adjusted is selected from the initial luminance values of the respective grayscale levels of the display device; and the initial color component value of the grayscale level corresponding to the selected initial luminance value is used as the initial color component value of the grayscale level to be adjusted.

6. The method according to claim 1, wherein an initial luminance value of a grayscale level is increased or decreased by increasing or decreasing an initial color component value of the grayscale level.

7. An apparatus for adjusting luminance of a display device, the apparatus comprising:

a memory storing target gray scale curve data; and a processor configured to:

enable the display device to display a grayscale level image for each grayscale level;

obtain an initial luminance value of each grayscale level;

determine the maximum luminance value and the minimum luminance value according to the initial luminance values;

determine a gray scale level interval on a target gray scale curve based on the maximum luminance value and the minimum luminance value;

determine a target luminance value for each grayscale level of the display device on the target gray scale curve according to the gray scale level interval;

adjust luminance of the grayscale level of the display device based on the determined target luminance value;

increase the initial luminance value of the grayscale level to be adjusted, if the target luminance value of the grayscale level to be adjusted is higher than the initial luminance value thereof; and decrease the initial luminance value of the grayscale level to be adjusted, if the target luminance value of the grayscale level to be adjusted is lower than the initial luminance value thereof;

determine, for each of the adjusted grayscale levels, whether the adjusted initial luminance value satisfies a predetermined condition; and repeat the adjusting if the adjusted initial luminance value does not satisfy the predetermined condition, until all the adjusted initial luminance values satisfy the predetermined condition;

wherein the predetermined condition is:

$$\frac{|R_{adjust}(j) - R_{target}(j)|}{R_{target}(j)} \leq p,$$

where $$R_{adjust}(j) = \frac{2 \times (L_{adjust}(j) - L_{adjust}(j-1))}{(L_{adjust}(j) + L_{adjust}(j-1)) \times (T(j) - T(j-1))},$$

$$R_{target}(j) = \frac{2 \times (L_{target}(j) - L_{target}(j-1))}{(L_{target}(j) + L_{target}(j-1)) \times (T(j) - T(j-1))},$$

$L_{adjust}(j)$ is the adjusted initial luminance value of the j-th grayscale level, $L_{target}(j)$ is the target luminance value of the j-th grayscale level, T(j) is the gray scale level value of the j-th grayscale level, and p is a constant between 0 and 1, where j=1, 2, . . . , N−1, and N is the number of the gray scale levels of the display device.

8. The apparatus according to claim 7, wherein the maximum luminance value and the minimum luminance value are a maximum luminance value and a minimum luminance value of the grayscale levels of the display device, respectively.

9. The apparatus according to claim 7, wherein the maximum luminance value and the minimum luminance value to be set are a maximum luminance value and a minimum luminance value, respectively, which are set according to a predefined standard.

10. The apparatus according to claim 7, wherein the processor is further configured to:

equally divide the gray scale level interval by the number of the grayscale levels of the display device; and determine a luminance value corresponding to each equal-division point on the target gray scale curve as the target luminance value for corresponding grayscale level of the display device.

11. The apparatus according to claim 7, wherein the initial color component value is read from the display device, and the processor is further configured to:

select the initial luminance value which is closest to the target luminance value of the grayscale level to be adjusted from the initial luminance values of the respective grayscale levels of the display device; and use the initial color component value of the grayscale level corresponding to the selected initial luminance value as the initial color component value of the grayscale level to be adjusted.

12. The apparatus according to claim 7, wherein the processor is further configured to increase or decrease an initial luminance value of a grayscale level by increasing or decreasing an initial color component value of the grayscale level.

* * * * *